US007299714B1

(12) United States Patent
Jermyn

(10) Patent No.: US 7,299,714 B1
(45) **Date of Patent: *Nov. 27, 2007**

(54) TELESCOPING AND LOCKING LEVER ARM

(75) Inventor: Richard Jermyn, Panama City, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 54 days.

This patent is subject to a terminal disclaimer.

(21) Appl. No.: 11/274,710

(22) Filed: Nov. 14, 2005

Related U.S. Application Data

(62) Division of application No. 10/384,927, filed on Mar. 3, 2003, now Pat. No. 7,007,569.

(51) Int. Cl.
*G05G 1/04* (2006.01)

(52) U.S. Cl. ..... 74/525; 74/543

(58) Field of Classification Search ..... 74/523, 74/525, 543, 544, 546, 548; 294/1.4; 89/1.81; 474/82; 446/195; 604/71
See application file for complete search history.

(56) References Cited

U.S. PATENT DOCUMENTS 2,687,724 A * 8/1954 Frank et al. ..... 604/71
3,208,183 A * 9/1965 Neumann ..... 446/195
5,103,524 A * 4/1992 Vowles ..... 15/3.51
5,617,757 A * 4/1997 Horner ..... 73/290 V
6,132,390 A * 10/2000 Cookston et al. ..... 600/585
6,517,456 B1 * 2/2003 Savard ..... 474/82
6,530,305 B1 * 3/2003 MacLeod et al. ..... 89/1.81
6,880,873 B2 * 4/2005 Stoev ..... 294/1.4

* cited by examiner

*Primary Examiner*—Vinh T. Luong
(74) *Attorney, Agent, or Firm*—James T. Shepherd

(57) ABSTRACT

A telescoping lever arm comprises a tube and a rod. The tube has an opening at one end thereof and has an inner circumferential dimension along the inside thereof. The opening is smaller than the inner circumferential dimension of the tube. The rod has an outer circumferential dimension that is smaller than that of the tube's opening. The rod resides partially in the tube and extends therefrom via the tube's opening. At least one annular flange is coupled to the rod at a portion thereof residing in the tube. Each such annular flange is defined by a circumferential dimension that is larger than that of the tube's opening and smaller than the inner circumferential dimension of the tube. The other end of the tube is configured to be coupled to a workpiece or an adapter that can be coupled to a workpiece.

12 Claims, 2 Drawing Sheets

TELESCOPING AND LOCKING LEVER ARM

CROSS-REFERENCE TO RELATED APPLICATIONS

This is a divisional application, claiming the benefit of parent application Ser. No. 10/384,927 filed on Mar. 3, 2003 now U.S. Pat. No. 7,007,569, the entire disclosure of which is incorporated hereby by reference.

STATEMENT OF GOVERNMENT INTEREST

The invention described herein may be manufactured and used by or for the Government of the United States of America for governmental purposes without the payment of any royalties thereon or therefor.

FIELD OF THE INVENTION

The invention relates generally to lever arms, and more particularly to a telescoping lever arm that locks to prevent axial telescoping action when the lever arm is used to provide a mechanical advantage.

BACKGROUND OF THE INVENTION

Lever arms are used in a wide variety of applications to improve one's mechanical advantage for the tightening/loosening of couplings, bolts, nuts, etc. In most cases, a lever arm is a one-piece rigid bar or rod. However, some lever arms are constructed to telescope to provide a longer lever arm for greater mechanical advantage and to provide a shorter lever arm when there are space limitations.

Typically, a telescoping lever arm is moved to a desired position and is locked axially with respect to a handle to provide a desired lever arm length. Conventional locking has been accomplished by coupling the telescoping portion to the handle by using a removable pin or locking collar arrangement. However, these require the user to use both hands to make an adjustment. In addition, when used in confined spaces, the length of the lever arm may have to be adjusted during the use thereof. Such adjustment can be difficult or impossible if one must get both hands on the lever arm to make the adjustment.

SUMMARY OF THE INVENTION

Accordingly, it is an object of the present invention to provide a telescoping lever arm.

Another object of the present invention is to provide a telescoping lever arm that is simple to use.

Still another object of the present invention is to provide a telescoping lever arm that can be adjusted in length using only one hand.

Other objects and advantages of the present invention will become more obvious hereinafter in the specification and drawings.

In accordance with the present invention, a telescoping lever arm comprises a tube and a rod. The tube has an opening at one end thereof and has an inner circumferential dimension along the inside thereof. The opening is smaller than the inner circumferential dimension of the tube. The rod has an outer circumferential dimension that is smaller than that of the tube's opening. The rod resides partially in the tube and extends therefrom via the tube's opening. At least one annular flange is coupled to the rod at a portion thereof residing in the tube. Each such annular flange is defined by a circumferential dimension that is larger than that of the tube's opening and smaller than the inner circumferential dimension of the tube.

To use the present invention, a minimal axial force adjusts the length of the lever arm to suit space allocations or to provide a lesser/greater amount of mechanical advantage as needed. Next, a work force is applied to the rod in a direction that is substantially perpendicular to the longitudinal axis thereof. As a result, one or more frictional forces result between (i) the outboard edges of flange(s) and inner surface of the tube and (ii) the tube's opening and the rod. The frictional force(s) alone or in combination resist any increase in axial forces applied to the rod and axially lock the tube and rod together to form the lever arm.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
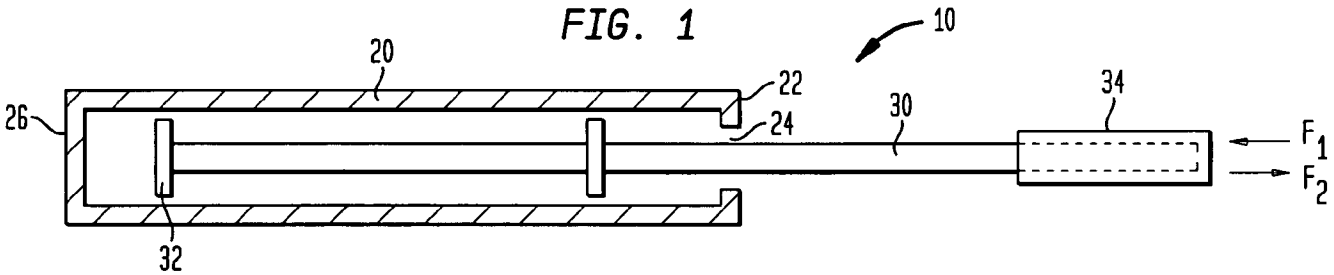
FIG. 1 is a part side, part cross-sectional view of one embodiment of a telescoping and locking lever arm in accordance with the present invention.

Referring now to the drawings, and more particularly to FIG. 1, one embodiment of a telescoping and locking lever arm is shown and referenced generally by numeral 10. Lever arm 10 can be adapted for use in any application requiring the use of a lever arm to provide a mechanical advantage. Such applications can include, but are not limited to, the tightening/loosening of bolts, nuts, etc., the locking/unlocking of cam locks, or the rotational movement of other rotating types of device requiring a mechanical advantage to bring about such rotation.

Lever arm 10 has an outer tube 20 shown in cross-section and an inner rod 30 shown in a side view. Tube 20 is rigid and hollow with an inner dimension defined along its length. At one end 22 of tube 20, an opening 24 is formed such that opening 24 is smaller than the inner dimension defined by tube 20. Note that end 22/opening 24 can be integrated with tube 20 or could be in the form of a removable part to facilitate assembly/disassembly of lever arm 10. At the opposing end 26 of tube 20, provisions are made for the coupling of lever arm 10 to a workpiece (not shown). As will be explained further below, end 26 can be configured to accept attachment of a variety of adapters (e.g., socket heads, wrench heads, etc.) that can be coupled to a workpiece. Alternatively, end 26 can be configured in a particular fashion for coupling directly to a workpiece.

Rod 30 is rigid and is sized to fit easily through opening 24 in tube 20 with a portion thereof residing in tube 20 and a portion thereof extending from tube 20. Integral with rod 30 (or rigidly coupled thereto) are one or more (e.g., two are shown) annular flanges or disks 32 spaced apart along rod 30 within tube 20. The dimensions of flanges 32 are such that they move easily in an axial direction in tube 20 but cannot pass through opening 24. Thus, axial movement of rod 30 in tube 20 requires a minimal axial force (e.g., $F_1$ or $F_2$) on rod 30. The particular sizes of the interior of tube 20, opening 24, rod 30 and flanges 32 can be adjusted to suit a particular application or to provide adaptability to a wide variety of applications. Gripping of rod 30 can be facilitated by either incorporating a grip (e.g., ridges, knurls, etc.) onto the end of rod 30 or by attaching a grip 34 thereto.

Figure 2B:
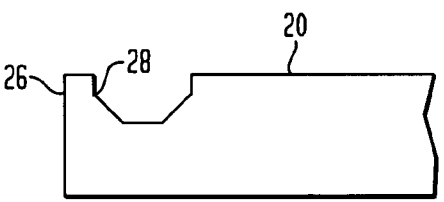
FIG. 2B is a side view of another possible configuration for the end of the lever arm's tube in which the end is pre-shaped to cooperate with a specific workpiece.
Figure 2A:
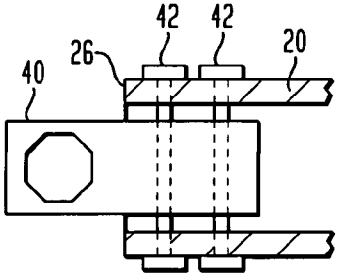
FIG. 2A is a side, cross-sectional view of one possible configuration for the end of the lever arm's tube in which a workpiece connector can be mounted thereto.

As mentioned above, end 26 of tube 20 can be configured as shown in FIG. 2A where an adapter 40 (e.g., socket head, wrench head, etc.) is attached to end 26 by any one of a variety of attachment schemes such as feedthrough fasteners 42. Alternatively, end 26 can be configured as shown in FIG. 2B where end 26 is formed/shaped, for example, to incorporate a wrench opening 28 for the direct coupling to a workpiece.

The outer/inner shape of tube 20, outer shape of rod 30, and outer shape of flange(s) 32 can be circular. In such a case, tube 20 is a cylindrical tube having an inner diameter that is (i) larger than the diameter of rod 30 which is cylindrical and (ii) larger than the diameter of circular disk(s) or flange(s) 32. Opening 24 could be circular with its diameter being larger than that of rod 30 and smaller than that of disk(s) of flange(s) 32. However, it is to be understood that the inner circumferential dimension of tube 20, opening 24 and the outer circumferential dimensions of rods 30 and flange(s) 32 need not be circular. Other geometrical shapes such as triangles, squares, etc. can be used without departing from the scope of the present invention.

Figure 3:
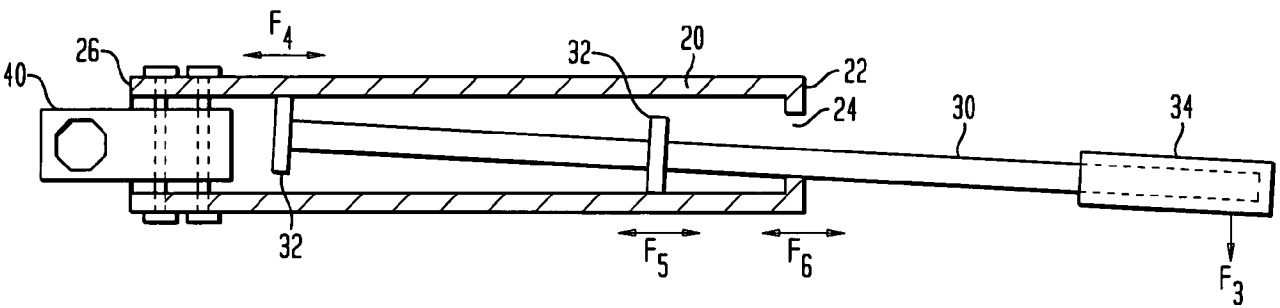
FIG. 3 is a part side, part cross-sectional view of the lever arm with a torque force applied thereto that causes the lever arm's rod and tube to be axially locked to one another in accordance with the present invention.

Use of the present invention will now be explained with the aid of FIG. 3 where it is assumed that adapter 40 is coupled to a workpiece. A minimal axial force $F_1$ or $F_2$ (FIG. 1) is used to adjust the length of lever arm 10 to suit space allocations or to provide a lesser/greater amount of mechanical advantage as needed. Next, a force $F_3$ (FIG. 3) is applied to rod 30 in a direction that is substantially perpendicular to the longitudinal axis thereof. As a result, one or more frictional forces result between (i) the outboard edges of flange(s) 32 and inner surface of tube 20 (i.e., $F_4$ and $F_5$) and (ii) opening 24 and rod 30 (i.e., $F_6$). The presence of one or more of frictional forces $F_4$-$F_6$ depends on factors such as the length of lever arm 10, the size of opening 24, the diameter of rod 30 and/or the diameter of flange(s) 32. The frictional force(s) alone or in combination resist any increase in axial forces $F_1$ or $F_2$ as force $F_3$ is applied to rod 30. Thus, under the applied "work" force $F_3$, tube 20 and rod 30 are axially locked together to form the lever arm.

Figure 4:
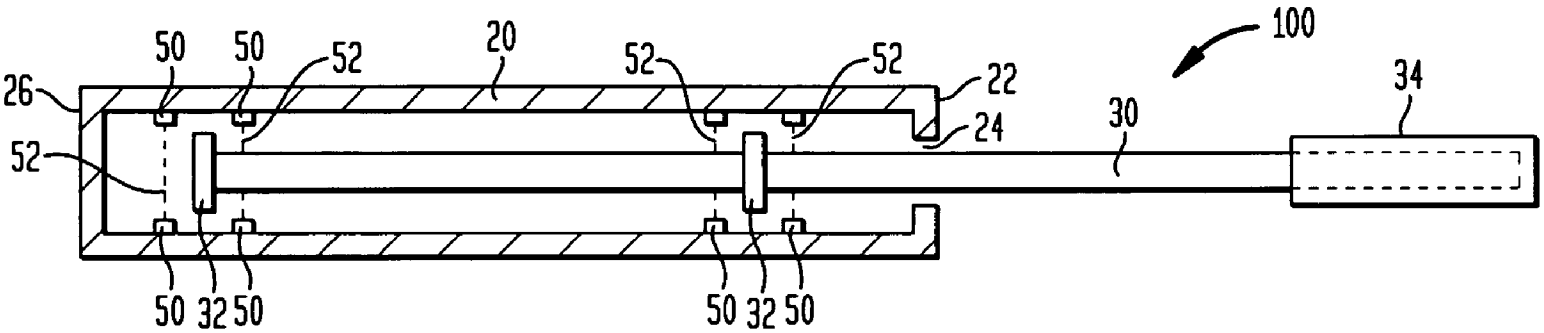
FIG. 4 is a part side, part cross-sectional view of another embodiment of a telescoping and locking lever arm in accordance with the present invention.
Figure 5:
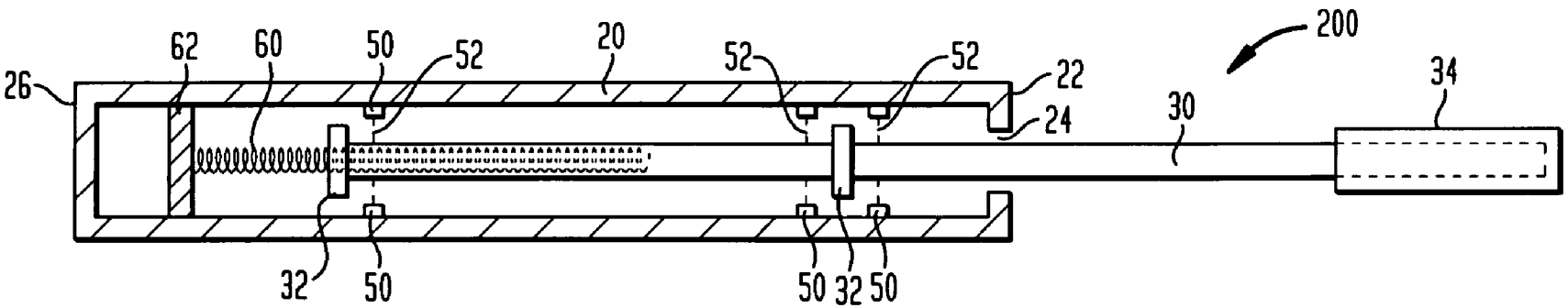
FIG. 5 is a part side, part cross-sectional view of another embodiment of a telescoping and locking lever arm in accordance with the present invention.

The present invention is not limited to the embodiment just described as is evidenced by additional embodiments illustrated in FIGS. 4 and 5. More specifically, FIG. 4 illustrates a lever arm 100 in which tube 20 is configured to have a plurality of annular ribs 50 formed on the inner surface of tube 20. Ribs 50 define openings or passages (referenced by dashed lines 52) that allow rod 30 and flange(s) 32 to easily pass therethrough. Ribs 50 give tube 20 additional strength and serve as locking "stops" for flange(s) 32 when a "work" force (i.e., similar to force $F_3$ described above) is applied perpendicularly to the longitudinal axis of rod 30.

Lever arm 200 illustrated in FIG. 5 is further equipped with a spring 60 mounted, for example, to a plate 62 fixed in tube 20 so that spring 60 extends axially along a central longitudinal axis of tube 20. Rod 30 is partially hollowed out to receive spring 60 therein. In this way, when no "work" force (i.e., similar to force $F_3$ described above) is applied to rod 30, spring 60 will tend to centrally align rod 30 in tube 20. This will facilitate axial movement of rod 30/flange(s) 32 (and spring 60) through ribs 50. Note that ribs 50 could also be eliminated from lever arm 200 without departing from the scope of the present invention.

The advantages of the present invention are numerous. The lever arm easily telescopes to either a short length for storage purposes or to a particular desired lever length throughout a range of desired lever lengths. Where space is limited, the lever can be locked in a shortened configuration. Where there is additional space, the lever can be locked in an extended configuration in order to provide additional output torque. Once the desired lever length is selected, the lever locks at that length while under the applied torque load. The narrow/sharp edges of the locking disks increase point loading to increase frictional forces at contact areas. If sufficiently small contact area is designed, the contact surfaces can actually deflect or dig into each other so as to have a very large axial locking effect.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A telescoping lever arm, comprising:

a tube having an opening at a first end thereof and a second end configured for coupling to at least one of a workpiece and an adapter that can be coupled to a workpiece, said tube having an inner circumferential dimension along the inside thereof, wherein said opening is smaller than said inner circumferential dimension;

a rod having an outer circumferential dimension that is smaller than that of said opening, said rod residing partially in said tube and extending therefrom via said opening;

at least one annular flange coupled to said rod at a portion thereof residing in said tube, each said annular flange defined by a circumferential dimension that is larger than that of said opening and smaller than said inner circumferential dimension of said tube; and at least one annular rib formed on an inner surface of said tube, each said annular rib defining a passage large enough to pass said rod and each said annular flange.

2. A telescoping lever arm as in claim 1 wherein said rod includes a hollow portion defined in one end thereof that resides in said tube, said telescoping lever arm further comprising a spring having a first end coupled to said tube for axial extension along a central longitudinal axis of said tube, said spring extending axially into said hollow portion, and said spring having a second end coupled to said rod in said hollow portion.

3. A telescoping lever arm as in claim 1, wherein each said annular rib defines a passage large enough to pass said rod, said spring, and each said annular flange.

4. A telescoping lever arm as in claim 1 further comprising means for facilitating gripping of a portion of said rod extending from said tube.

5. A telescoping lever arm as in claim 4 wherein said means for facilitating is integral with said portion of said rod.

6. A telescoping lever arm as in claim 4 wherein said means for facilitating is coupled to said portion of said rod.

7. A telescoping lever arm, comprising:

a cylindrical tube having an inner diameter and having a circular opening at a first end thereof, wherein said circular opening defines a diameter that is smaller than said inner diameter, and wherein said tube has a second end configured for coupling to at least one of a workpiece and an adapter that can be coupled to a workpiece;

a cylindrical rod having an outer diameter that is smaller than that of said circular opening, said cylindrical rod residing partially in said cylindrical tube and extending therefrom via said circular opening;

at least one circular disk coupled to said cylindrical rod at a portion thereof residing in said cylindrical tube, each said circular disk defined by a diameter that is larger than that of said circular opening and smaller than said inner diameter of said cylindrical tube; and at least one annular rib formed on an inner surface of said cylindrical tube, each said annular rib defining a passage large enough to pass said cylindrical rod and each said circular disk.

8. A telescoping lever arm as in claim 7 wherein said cylindrical rod includes a hollow portion defined in one end thereof that resides in said cylindrical tube, said telescoping lever arm further comprising a spring having a first end coupled to said cylindrical tube for axial extension along a central longitudinal axis of said cylindrical tube, said spring extending axially into said hollow portion, and said spring having a second end coupled to said cylindrical rod in said hollow portion.

9. A telescoping lever arm as in claim 7, wherein each said annular rib defines a passage large enough to pass said cylindrical rod, said spring, and each said circular disk.

10. A telescoping lever arm as in claim 7 further comprising means for facilitating gripping of a portion of said cylindrical rod extending from said cylindrical tube.

11. A telescoping lever arm as in claim 10 wherein said means for facilitating is integral with said portion of said cylindrical rod.

12. A telescoping lever arm as in claim 10 wherein said means for facilitating is coupled to said portion of said cylindrical rod.

* * * * *